US005331827A

United States Patent [19]

Chlebak

[11] Patent Number: 5,331,827

[45] Date of Patent: Jul. 26, 1994

[54] ENHANCING EFFICIENCY OF REFRIGERANT-CIRCULATING COOLING SYSTEM

[76] Inventor: Ralph Chlebak, 3100 Kirwin Avenue, Apt. 1702, Mississauga, Ontario, Canada, M5A 3S6

[21] Appl. No.: 36,837

[22] Filed: Mar. 25, 1993

[30] Foreign Application Priority Data

Apr. 2, 1992 [CA] Canada ..... 2064976

[51] Int. Cl.[5] ..... F25B 39/04

[52] U.S. Cl. ..... 62/509; 62/513; 62/507

[58] Field of Search ..... 652/509, 513, 506, 507, 652/503

[56] References Cited

U.S. PATENT DOCUMENTS

| | | | |
|---|---|---|---|
| 1,526,961 | 2/1925 | Burrows | 165/108 |
| 2,518,587 | 8/1950 | Zearfoss | 62/503 |
| 3,553,974 | 1/1971 | Osborne | 62/115 |
| 4,142,381 | 3/1979 | Lavinge | 62/510 |
| 4,683,726 | 8/1987 | Barron | 62/513 X |
| 4,694,662 | 9/1987 | Adams | 62/509 |
| 4,773,234 | 9/1988 | Kann | 62/509 X |
| 4,807,449 | 2/1989 | Helmer | 62/509 X |

*Primary Examiner*—Harry B. Tanner
*Attorney, Agent, or Firm*—Mirek A. Waraksa

[57] ABSTRACT

A condenser is positioned in high-pressure refrigerant line of a cooling system. The condenser is formed of thermally-conductive material defining a closed reservoir for accumulating liquid refrigerant. An inlet receives the refirgerant flow from the high-pressure line and an outlet discharges the accumulated liquid refrigerant to an expansion valve. The conduit within the reservoir conducts the refrigerant flow from the inlet to a region of the reservoir above the outlet. The conduit is apertured to direct substantially all of the refrigerant flow against upper portions of the condenser, specifically against one side of the condenser. That side of the condenser is exposed to the flow of cold fluid mecium (typically air) produced by the system to condense a gaseous component of the refrigeration flow.

23 Claims, 3 Drawing Sheets

ENHANCING EFFICIENCY OF REFRIGERANT-CIRCULATING COOLING SYSTEM

FIELD OF THE INVENTION

The invention relates to cooling systems in which evaporation of a liquid refrigerant is used to draw heat from another fluid medium such as air or water, and more specifically, to devices for improving the efficiency of such colling systems.

BACKGROUND OF THE INVENTION

The invention has applicaiton inter alia to conventional refrigeration systems. Such systems commonly comprise an evaporating heat exchanger in which a liquid refrigerant, such as trichlorodofluoromethane (commonly available under the trade mark FREON) is evaporated to draw heat from an air flow (or alternatively a water flow). A compressor receives spent gaseous refrigerant from the heat exchanger along a suction line and discharges a compressed liquid refrigerant along a high-pressure line. A condenser, which is essentialy a heat exchanger, draws heat from the compressed refrigerant. Water is often used as a heat exchange medium in the condenser. The cooled refrigerant is conveyed along a high pressure line to an expansion valve associated with the evaporating heat exchanger and discharged through a narrow orifice to evaporate the liquid refrigerant and produce a cooling effect.

For proper and efficient operation, a "liquid seal" must be formed in the high pressure line upstream of the expansion valve. Otherwise, the expansion valve discharges gaseous refrigerant, which produces no cooling effect. In such systems, the liquid seal must extend from the condenser to the expansion valve. In practical applications, the expansion valve and evaporating heat exchanger are remote from the compressor and condenser. A high-pressure line exceeding a hundred feet is not unusual. This produces a requirement for a very substantial charge of liquid refrigerant and induces large pressure drops along the high-pressure line. The compressor must be sized accordingly and requires larger operating currents for operation. Also, formation of gaseous components reduces the efficiency of the expansion valve cannot be realistically avoided. Friction between the liquid refrigerant and surfaces of the high-pressure line causes formation of such gases. As well, the high-pressure line often extends through warm environments, once again creating gaseous components.

In the prior art, a condenser had been proposed and used to eliminate the requirement for a liquid seal extending from the system condenser to the expansion valve. Such a prior art condenser is structured substantially like the condenser 10 illustrated in FIG. 2. It has a thermally-conductive housing 12 defining a reservoir 14 for accumulating liquid refrigerant, an inlet 16 for receiving a refrigerant flow from the high pressure line, and an outlet 18 for discharging liquid refrigerant to the expansion valve. The inlet 16 and outlet 18 are aligned for installation in a straight section of the high pressure line and are positioned at the very bottom of the reservoir 14 to ensure that the outlet 18 remains immersed in liquid refrigerant. A U-shaped conduit 20 receives a refrigerant flow from the inlet 16 and terminates blind-ended proximate to the inlet 16 end of the housing 12. It has apertures (only one apertures 22 specifically indicated) on both opposing lateral sides of the conduit 20 that discharge the received refrigerant flow into the reservoir 14. In use, the condenser 10 is positioned in the path of cold air discharged from the evaporating heat exchanger, to condense gaseous components of the refrigerant in the high-pressure line.

To operate properly, the condenser 10 must condense the gaseous refrigerant at a rate correspdoning to the rate at which the expansion valve discharges liquid refrigerant. This is difficult to achieve over a short flow path, particularly in response to a "thin" cooling medium such as air. In the prior art condenser 10, the lower arm of its internal U-shaped internal conduit 20 is apertured below the operating liquid level of the condenser 10, which must be above the outlet 18. It consequently discharges a very large part of the high-pressure stream of refrigerant gas into the condensed, liquid refrigerant that tends to accumulate at the bottom of the reservoir 14 and the rest of the refrigerant gas towards various locations about the housing 12. This does not provide for optimal condensing of gaseous components. If the system must be charged to maintain more liquid refrigerant in the high-pressure line to accommodate slow condensing, this defeats the object of reducing line losses and simply introduces a significant restriction to liquid flow and incidental load in the high-pressure line. Such prior art condensers have been known to lead to compressor failure.

BRIEF SUMMARY OF THE INVENTION

In one aspect, the invention provides a system for cooling a fluid medium by evaporation of a refrigerant. The system comprises an evaporating heat exchanger with separate flow paths for the refrigerant and the fluid medium, the flow paths being in thermal communication for heat exchange. An expansion valve discharges liquid refrigerant into the refrigerant flow path for evaporation and cooling of the fluid medium. A compressor receives spent gaseous refrigerant along a suction line from the evaporating heat exchanger. It discharges compressed refrigerant along a high pressure line coupling the compressor to the expansion valve. A heat exchanger in the high pressure line cools the compressed refrigerant. A condenser is positioned in the high pressure line between the refrigerant-cooling heat exchanger and evaporating heat exchanger. The condenser comprises a housing formed with a thermally conductive material and defining a closed reservoir for accumulating liquid refrigerant. The housing comprises an inlet to receive a refrigerant flow from the high pressure line and an outlet discharging the accumulated liquid refrigerant along the high pressure line toward the expansion valve. A conduit communicates with the housing inlet and conducts the refrigerant flow to a predetermined region of the reservoir above the housing outlet, consequently above the liquid operating level of the condenser. The housing comprises a housing portion positioned to immediately confront the cold fluid medium discharged from the evaporating heat exchanger and the conduit is apertured in the predetermined region of the reservoir about the housing outlet to discharge substantially all of the refrigerant flow against that housing portion. This induces condensing of gaseous refrigerant components in response to contact with the housing portion. The advantage of the invention is most apparent when the fluid medium is air.

In another aspect, the invention provides a condenser for condensing a gaseous component of a high pressure refrigerant flow in response to a cold air flow. The condenser comprises a housing formed of thermally conductive material and defining a closed reservoir for accumulating liquid refrigerant. The housing has a generally cylindrical sidewall and a pair of end walls. One end wall comprises an inlet for receiving the refrigerant flow. The other end wall comprises an outlet for discharging accumulating liquid refrigerant. The inlet and outlet are aligned with a predetermined axis approximate to the bottom of the reservoir, to facilitate installation in straight-line sections of a high pressure line. A conduit within the reservoir communicates with the inlet. The conduit comprises a lower solid-walled conduit portion shaped to conduct the refrigerant from the inlet to a predetermined region of the reservoir about both the housing inlet and the housing outlet. It also comprises an upper conduit portion oriented substantially parallel to the predetermined axis. The upper conduit portion terminates substantially blind-ended proximate to the housing end wall that comprises the outlet. The upper conduit portion has a multiplicity of apertures for discharging the refrigerant flow. The apertures are distributed such that the discharged refrigerant flow is distributed along substantially the full length of the housing sidewall, taking full advantage of the cold surface available for condensing of gaseous refrigerant components, and are oriented to direct substantially all of the discharged refrigerant against upper portions of the housing sidewall above the housing outlet.

Other aspects of the invention will be apparent from a description below of preferred embodiments and will be more specifically defined in the appended claims. Although the preferred embodiments of the invention are described in the context of a particular refrigeration system, it should be appreciated that the invention has application to a variety of cooling systems, including air conditioning systems.

DESCRIPTION OF THE DRAWINGS

The invention will be better understood with reference to drawings in which.

DESCRIPTION OF PREFERRED EMBODIMENTS

Figure 1:
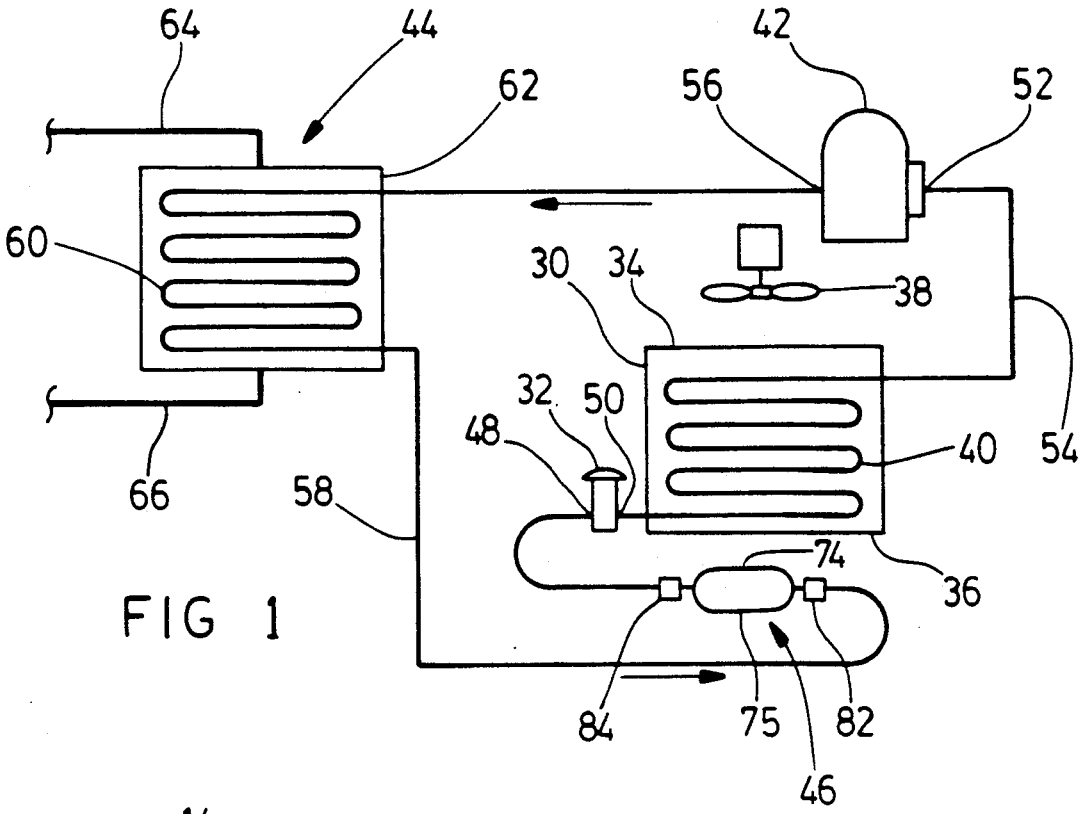
FIG. 1 is a diagrammatic view of a refrigeration system incorporating a condenser constructed according to the invention.
Figure 2:
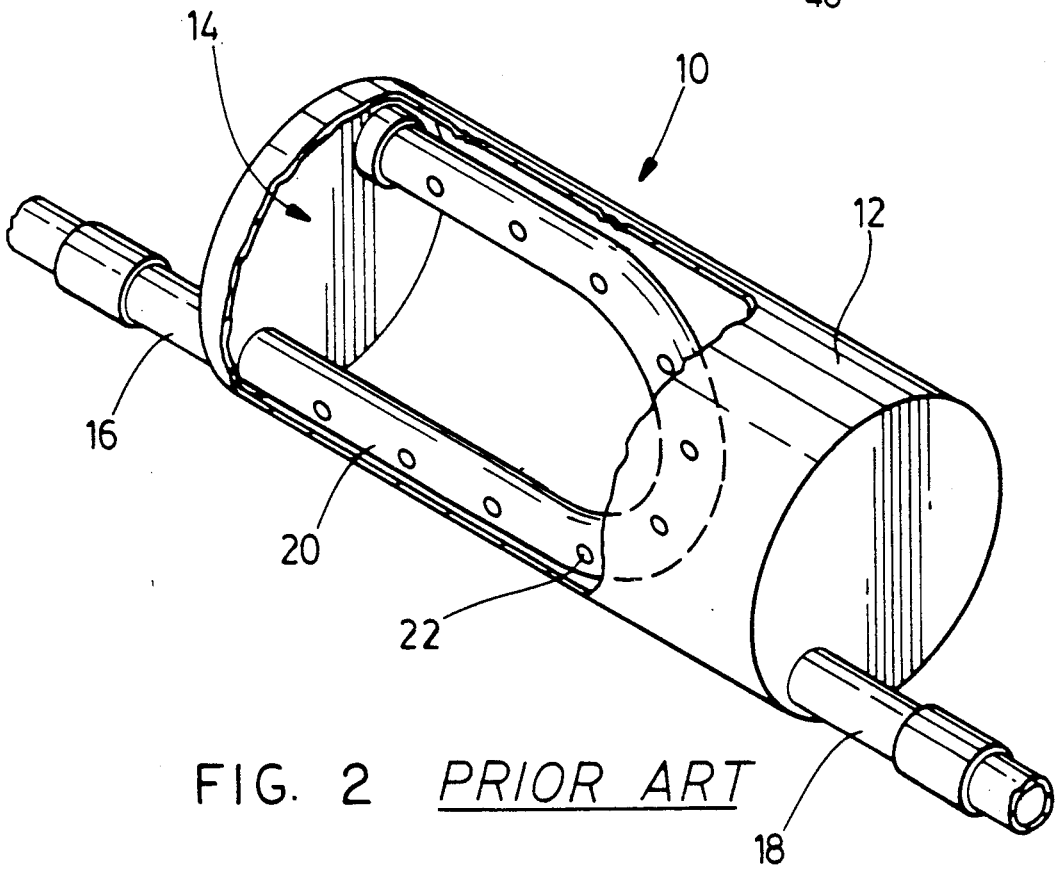
FIG. 2 PRIOR ART
FIG. 2 is a perspective view of a prior art condenser.

Reference is made to FIG. 1 which diagrammatically illustrates a refrigeration system adapted to produce cold air flows. The system includes an evaporating heat exchanger 30 of conventional construction comprising an expansion valve 32 and operated with a refrigerant such as FREON TM. It has an open rear face 34 that receives air to be cooled and an open forward face 36 that discharges the cold air flow. An electric fan 38 produces an air flow along the flow path between the rear and forward faces 34, 36. Copper tubing 40 in the interior of the heat exchanger 30 defines a second separate flow path in which the refrigerant is evaporated. The tubing 40 will commonly carry a network of aluminum fins (not illustrated) that enhances heat exchange between the air and refrigerant flow through the heat exchanger 30. The system also includes a compressor 42 that compresses and circulates the refrigerant, and a condenser 44 that removes heat from the compressed refrigerant. A condenser 46 is located proximate to the heat exchanger 30 for purposes of forming a liquid seal immediately upstream of the expansion valve 32.

The expansion valve 32 has a high pressure inlet 48 where liquid refrigerant under pressure is received. It has a low pressure outlet 50 that discharges the liquid refrigerant into the tubing 40 of the heat exchanger 30 for evaporation. The compressor 42 has a low pressure inlet 52 coupled by a suction line 54 to the outlet end of the tubing 40 to receive spent gaseous refrigerant. It has a high pressure outlet 56 that discharges the compressed refrigerant along a high-pressure line 58 leading back to the expansion valve 32. The condenser 44 is located in the high-pressure line 58 proximate to the compressor 42 to immediately receive and cool the compressed refrigerant flow. The compressed refrigerant may travel through a convoluted flow path defined by bent tubing 60 in the interior of the condenser 44. A jacket 62 may be formed around the tubing 60 with an inlet 64 to receive a cold water flow and an outlet 66 to discharge water warmed by heat exchange with the compressed refrigerant. The cooling water will often be circulated to a cooling tower external the building where a heat exchanger operated with air flows will cool the water. Although not apparent in the diagrammatic representation of FIG. 1, the expansion valve 32 would normally positioned a considerable distance from the condenser 44.

Figure 3:
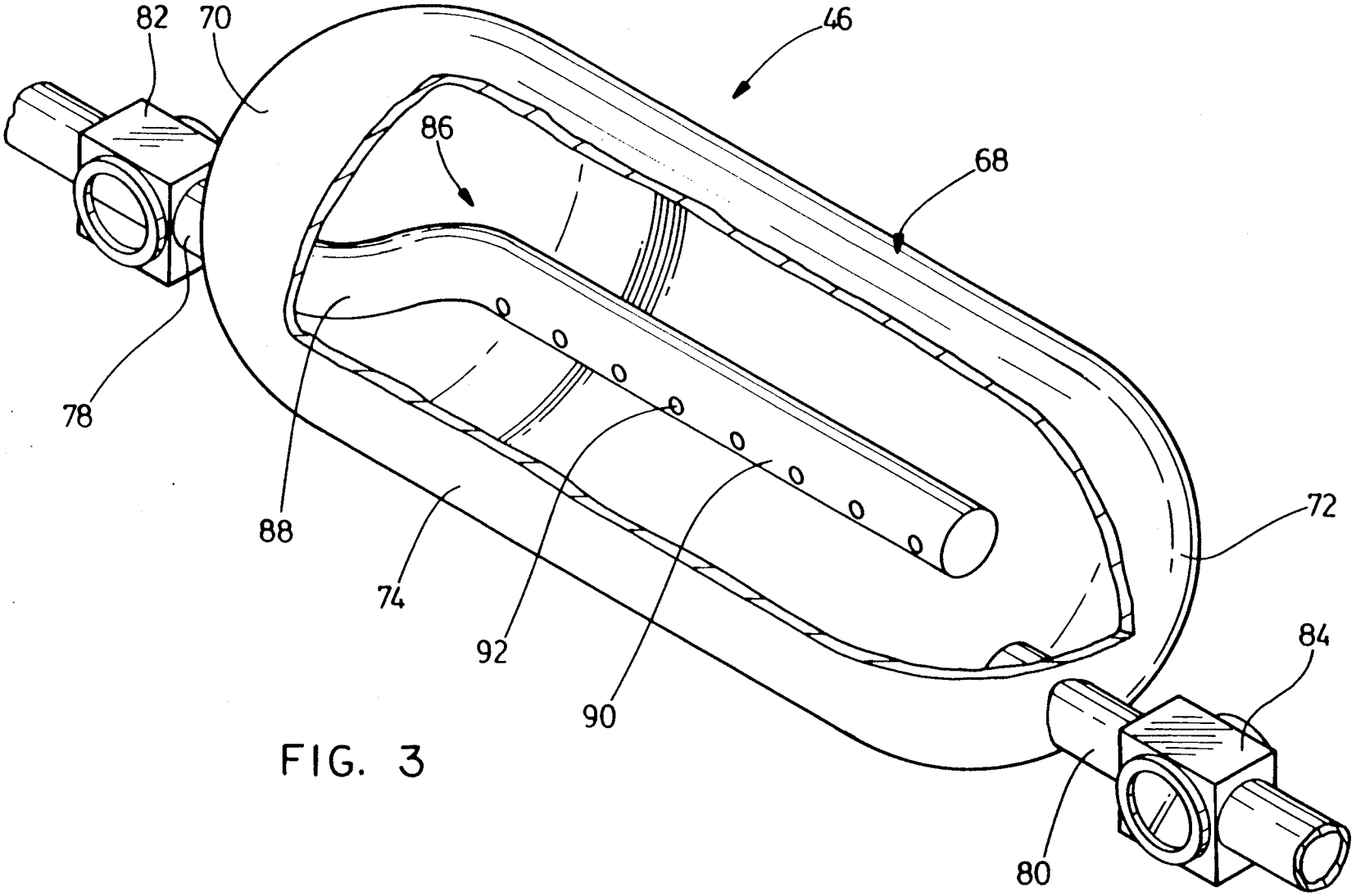
FIG. 3 is a fragmented perspective view of the condenser of the present invention.
Figure 4:
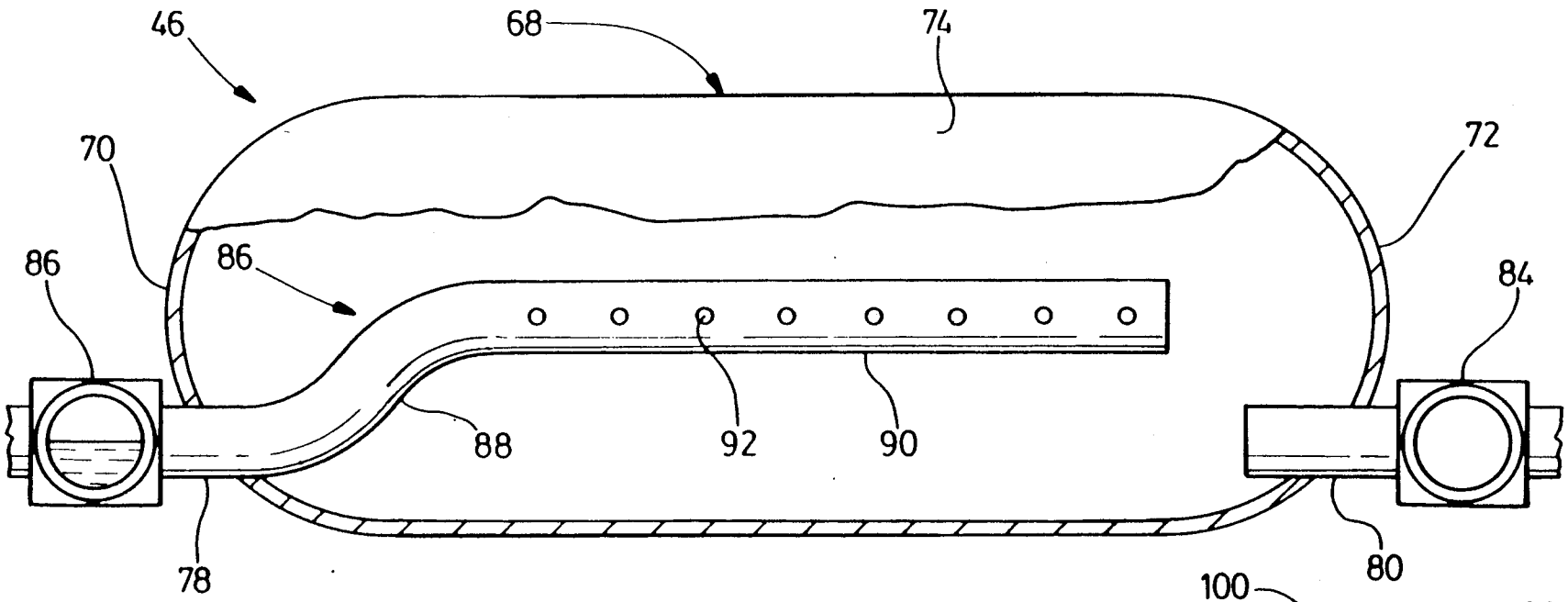
FIG. 4 is a fragmented elevational view of the condenser of FIG. 3.

The condenser 46 is illustrated in detail in FIGS. 3 and 4. The condenser 46 comprises a housing formed of copper. The housing has an elongate circular cylindrical sidewall 68 and a pair of half-spherical end walls 70, 72. The sidewall 68 defines opposing half-cylindrical lateral side portions 74, 75. The housing may have a seamless spin-formed construction in which axially opposing ends are closed by brazing. The housing defines a closed reservoir 76 intended to accumulate liquid refrigerant.

One end wall 70 has a conduit section serving as an inlet 78 to receive the refrigerant flow from the high-pressure line 58. The other end wall 72 has a conduit section constituting an outlet 80 for discharging liquid refrigerant accumulated within the reservoir 76 toward the expansion valve 32. The inlet 78 and outlet 80 are aligned along a predetermined axis (not indicated) to facilitate installation in a straight-line section of the high-pressure line 58. Each is spaced about one-quarter inch from the bottom of the reservoir 76 thereby providing space for settling and accumulation of debris carried by the refrigerant. The prior art condenser 10 has made no provision for such matters. The inlet 78 carries a sight glass 82 to permit observation of refrigerant flows into the reservoir 76. Another sight glass 84 is formed with the outlet 80 to permit observation of the liquid refrigerant flow discharged toward the expansion valve 32. The sight glasses permit convenient adjustment of the system refrigerant charge to reflect installation of the condenser 46, as discussed more fully below.

A conduit 86 is located within the reservoir 76. The conduit 86 has a lower-walled portion 88 integrally formed with the housing inlet inlet 78. It curves upwardly to direct the received refrigerant flow to a region of the reservoir 76 above the inlet 78 and outlet 80 of the housing. It comprises an upper conduit portion 90 that is substantially straight and oriented substantially parallel to the alignment axis of the inlet 78 and outlet 80 and also to the one lateral side portion 74 of the housing. The upper conduit portion 90 is formed with eight apertures (only one such aperture being specifically indicated with reference numeral 92), each having a diameter of about 3/32 inches. The diameter is significant. In the prior art condenser 10, the discharge apertures had a diameter of about 1/16 inch. That appears conducive to trapping of debris and further flow restriction, which is believed to have been a factor contributing to the compressor-failure observed with use of such prior art condensers.

The apertures all face toward one lateral side portion 74 of the condenser housing. They are spaced apart about one-quarter inch edge-to-edge along the length of the upper conduit portion 90. The upper conduit portion 90 consequently discharges substantially all of the received refrigerant flow against upper portions of the housing, above the housing outlet 80, and distributes the discharge along substantially the full length of the one lateral sidewall portion 74. That, of course, is the housing portion which immediately and directly confronts the cooled air flow discharged from the evaporating heat exchanger 30. This tends to induce the more immediate condensing of gaseous refrigerant components of the discharged flow. It also takes better advantage of the expanse of housing exposed to the cold air flow. Although copper is an excellent heat conductor, it should be noted that warmer liquid and gas are constantly circulated through the condenser 46 so that temperature differentials are apt to arise.

The housing sidewall 68 has a diameter of about $2\frac{5}{8}$ inches. The length of the housing between extreme centre points of its end walls 70, 72 is about $7\frac{1}{4}$ inches. The housing walls have a thickness of about 0.08 inches. The inlet 78, outlet 80 and internal conduit 86 of the condenser 46 have a nominal internal diameter of $\frac{3}{8}$ inches. The condenser 46 is consequently appropriate for use with a relatively low-tonnage refrigeration system employing a $\frac{3}{8}$ inch high-pressure line. The nominal operating pressure in the high-pressure line would likely be in the general range of 150–250 pounds per square inch.

The condenser 46 would be appropriately installed in the high-pressure line 58 by providing a break in the line and soldering the condenser 46 in place. About one-half of the refrigerant charge originally in the system is exhausted. The refrigerant level is adjusted by viewing the sight glasses associated with the condenser 46. As a general rule, the system should be charged such that the upstream sight glass 82 shows bubbles and is approximately half-full of liquid refrigerant and downstream the sight glass 84 is clear (filled with liquid refrigerant). In actual testing of prototype condensers substantially identical to the condenser 46 in actual refrigeration systems, the power consumption of the system compressors has been reduced by about 26% under otherwise equal operating conditions, and the system compressors do not appear adversely affected.

Figure 5:
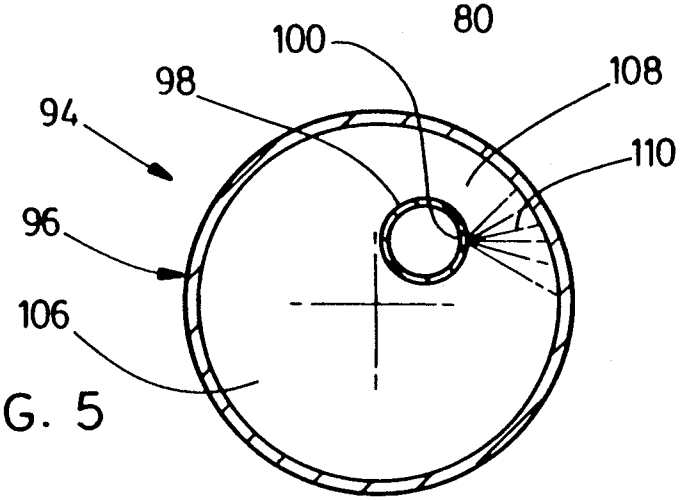
FIG. 5 is a cross-sectional view of a second embodiment of a condenser constructed according to the invention, indicating relative positioning of an apertured conduit portion relative to a condenser sidewall.

Other aspects of the positioning of apertured discharge conduits for condensers of the invention will be discussed with reference to FIG. 5. FIG. 5 illustrates in cross-section a similar condenser 94 sized for a larger refrigeration system that uses three-quarter inch internal diameter pipe to circulate refrigerant. The condenser 94 has a housing 96 with a diameter of about $4\frac{1}{8}$ inches and a length of approximately 13 inches. It has a comparable internal conduit with a $\frac{3}{4}$ inch internal diameter, the upper apertured portion 98 of which is apparent in cross-section in FIG. 5. The conduit portion 98 extends lengthwise along the housing 96, substantially parallel to one lateral sidewall portion 100. The upper conduit portion 98 has 32 apertures of 3/32 inch diameter spaced edge-to-edge by $\frac{1}{4}$ inch along its length. Only one such aperture 102 is apparent in the view of FIG. 5.

Several aspects of the positioning of the upper apertured conduit portion 98 of the larger condenser 94 should be noted. First, it is located above a hypothetical horizontal plane 104 substantially mid-way between the top and bottom of the reservoir 106 defined by the condenser housing 96. This elevation of the apertured conduit portion 98 is conducive to discharge of refrigerant over upper portions of the housing 96, rather than the lower portions where the liquid refrigerant is apt to accumulate and absorb heat from the sidewall. Additionally, the upper conduit portion 98 is positioned in the upper right-hand quadrant 108 of the reservoir 106 as viewed in FIG. 5, from its inlet toward the outlet. With the specified aperture size, the apertured conduit portion 98 is preferably positioned about one and one-quarter inches to about one and one-half inches from the lateral sidewall portion 100. (Such distance measurements for purposes of this specification are to the associated apertures.) This focuses the discharge 110 (diagrammatically illustrated with cross-hatching) not only against the upper housing portions, but specifically against the one lateral sidewall portion 100. That side of the housing 96 is of course to be exposed to the cold air flow produced by the evaporating heat exchanger of the refrigeration system in which the condenser 94 is installed. The apertured conduit portion 90 of the smaller condenser 46 is similarly spaced from the top and side of its housing sidewall 68. However, the limited diameter of its sidewall 68 gives the appearance of substantial centering of the conduit portion 90.

The advantage of directly discharging refrigerant flows against a particular condenser housing portion is pronounced in air-cooling systems since air is a thin cooling medium. With systems involving water-cooling, the condenser of the invention would be formed with a jacket about its housing portion defining the reservoir for accumulating condensed refrigerant. The jacket would have an inlet for receiving a portion of the cold water flow discharged from an evaporating heat exchanger and an outlet for returning the cooled water flow to its normal destination. The by-passed water flow would be directed immediately toward the condenser housing portion against which the refrigerant is discharged by the condenser's apertured internal conduit. That housing portion may be the top of the housing, and substantially all refrigerant flow may be discharged upwardly. However, because of the high thermal mass of water, the benefits of the invention are apt to be markedly reduced.

It will be appreciated that particular embodiments of the invention have been described and that modifications may be made therein without departing from the spirit of the invention or necessarily departing from the scope of the appended claims.

I claim:

1. A system for cooling a fluid medium in response to evaporation of a refrigerant, comprising:

an evaporating heat exchanger comprising a first flow path for the refrigerant, an expansion valve for discharging liquid refrigerant into the first flow path for evaporation, and a second flow path in thermal communication with the first flow path, the second flow path comprising an inlet for receiving the fluid medium for cooling in response to the evaporation of the refrigerant and an outlet for discharging a flow of cold fluid medium;

a compressor for compressing the refrigerant, the compressor comprising an inlet for receiving gaseous refrigerant and an outlet for discharging compressed refrigerant;

a suction line coupling the compressor inlet to the first flow path of the evaporating heat exchanger for receipt of spent gaseous refrigerant;

a high pressure line coupling the compressor outlet to the expansion valve;

a heat exchanger in the high pressure line for cooling the compressed refrigerant discharged from the compressor; and, a condenser in the high pressure line between the refrigerant-cooling heat exchanger and the evaporating heat exchanger, the condenser comprising a housing formed of a thermally-conductive material and defining a closed reservoir for accumulating liquid refrigerant, the housing comprising an inlet receiving a refrigerant flow from the high pressure line and an outlet discharging the accumulated liquid refrigerant along the high pressure line toward the expansion valve, the condenser comprising a conduit communicating with the housing inlet and conducting the refrigerant flow to a predetermined region of the reservoir above the housing outlet, the housing comprising a housing portion positioned to immediately confront the cold fluid medium discharged from the evaporating heat-exchanger and the conduit being so apertured in the predetermined region above the housing outlet that substantially all of the refrigerant flow is discharged from the conduit against the housing portion thereby to induce condensing of a gaseous refrigerant component of the refrigerant flow in response to contact with the housing portion.

2. The cooling system of claim 1 in which the fluid medium is air.

3. The cooling system of claim 2 in which:

the housing portion is elongate in a direction from the housing inlet to the housing outlet;

the conduit comprises a conduit portion located in the predetermined region above the housing outlet and formed with a multiplicity of apertures; and, the apertures face toward the housing portion and are spaced-apart along the length of the housing portion thereby to distribute the discharged refrigerant flow along the length of the housing portion.

4. The cooling system of claim 3 in which the conduit portion is positioned in an upper right-hand quadrant of the reservoir as viewed from the housing inlet toward the housing outlet.

5. The cooling system of claim 3 in which:

each of the apertures is substantially circular with a diameter of about 3/32 of an inch; and, the conduit portion is spaced between about one and one-quarter inches and one and one-half inches from the housing portion.

6. The cooling system of claim 2 in which the housing inlet and the housing outlet are aligned with a predetermined axis and are positioned a predetermined distance above the bottom of the reservoir thereby defining a region at the bottom of the reservoir in which debris can settle.

7. The cooling system of claim 2 in which:

the housing comprises a generally cylindrical sidewall and a pair of opposing end walls;

each of the housing inlet and outlet are attached to a different one of the end walls and are aligned along a predetermined axis proximate to the bottom of the reservoir;

the housing portion is one lateral side portion of the housing sidewall; and, the conduit comprises a lower conduit portion extending upwardly from the housing inlet to the predetermined region of the reservoir and an upper conduit portion substantially straight and oriented substantially parallel to the one lateral side portion of the housing; and, the upper conduit portion comprises a multiplicity of apertures spaced-apart along its length, each of the apertures facing toward the one lateral side portion.

8. The cooling system of claim 7 in which:

the internal diameter of the housing sidewall is in excess of about two and one-half inches;

each of the apertures is substantially circular with a diameter of about 3/32 of an inch; and, the upper conduit portion is positioned between about one and one-quarter inches from the one lateral side portion of the housing sidewall.

9. The cooling system of claim 8 in which the conduit portion is positioned in an upper right-hand quadrant of the reservoir as viewed from the housing inlet toward the housing outlet.

10. A condenser for condensing a gaseous component of a high-pressure refrigerant flow in response to a cold air flow, comprising:

a housing formed of a thermally-conductive material and defining a closed reservoir for accumulating liquid refrigerant, the housing comprising a sidewall and a pair of end walls, one of the end walls comprising an inlet for receiving the refrigerant flow and the other of the end walls comprising an outlet for discharging the accumulated liquid refrigerant, the sidewall defining a pair of opposing lateral housing side portions; and, a conduit within the reservoir, the conduit communicating with the inlet and being shaped to conduct the refrigerant flow from the inlet to a predetermined region of the reservoir above the outlet, the conduit being so apertured in the predetermined region of the reservoir that substantially all of the refrigerant flow is discharged from the conduit toward one of the lateral side portions of the housing;

whereby, the one lateral side portion of the housing may be positioned to confront the cold air flow to induce condensing of the gaseous component of the refrigerant flow discharged against the one lateral side portion.

11. The condenser of claim 10 in which:

the sidewall is elongate in a direction from the housing inlet to the housing outlet;

the conduit comprises a conduit portion located in the predetermined region above the housing outlet and formed with a multiplicity of apertures; and, the apertures face toward the one lateral side portion of the housing and are spaced-apart along the length of the one lateral side portion thereby to distribute the discharged refrigerant flow along the length of the one lateral side portion.

12. The condenser of claim 11 in which the conduit portion is positioned in an upper right-hand quadrant of the reservoir as viewed from the housing inlet toward the housing outlet.

13. The condenser of claim 11 in which:

each of the apertures is substantially circular with a diameter of about 3/32 of an inch; and, the conduit portion is spaced between about one and one-quarter inches and one and one-half inches from the one lateral side portion of the housing.

14. The condenser of claim 10 in which the inlet and the outlet are aligned with a predetermined axis and are positioned a predetermined distance above the bottom of the reservoir thereby defining a region at the bottom of the reservoir in which debris can settle.

15. The condenser of claim 10 in which:

the inlet and outlet of the condenser housing are aligned along a predetermined axis and are positioned proximate to the bottom of the reservoir;

the housing sidewall is substantially cylindrical;

the conduit comprises a lower solid-walled conduit portion extending upwardly from the housing inlet to the predetermined region of the reservoir and an upper conduit portion substantially straight and oriented substantially parallel to the one lateral side portion of the housing; and, the upper conduit portion comprises a multiplicity of apertures spaced-apart along its length, each of the apertures facing toward the one lateral side portion.

16. The condenser of claim 15 in which:

the internal diameter of the housing sidewall is in excess of about two and one-half inches;

each of the apertures is substantially circular with a diameter of about 3/32 of an inch; and, the upper conduit portion is positioned between about one and one-quarter inches from the one lateral side portion of the housing.

17. The condenser of claim 16 in which the conduit portion is positioned in an upper right-hand quadrant of the reservoir as viewed from the housing inlet toward the housing outlet.

18. The condenser of claim 10 in which the inlet comprises a sight glass for viewing the refrigerant flow through the inlet and the outlet comprises a sight glass for viewing the discharge of the accumulated liquid refrigerant from the outlet.

19. A condenser for condensing a gaseous component of a high-pressure refrigerant flow in response to a flow of a cold fluid medium, comprising:

a housing formed of a thermally-conductive material and defining a closed reservoir for accumulating liquid refrigerant, the housing comprising a sidewall and a pair of end walls, one of the end walls comprising an inlet for receiving the refrigerant flow and the other of the end walls comprising an outlet for discharging the accumulated liquid refrigerant, the sidewall defining a pair of opposing side portions; and, a conduit within the reservoir, the conduit communicating with the inlet and being shaped to conduct the refrigerant flow from the inlet to a predetermined region of the reservoir above the outlet, the conduit being so apertured in the predetermined region of the reservoir that substantially all of the refrigerant flow is discharged from the conduit toward the one lateral side portion of the housing;

whereby, the one lateral side portion of the housing may be oriented to confront the flow of the cold fluid medium to induce condensing of the gaseous component of the refrigerant flow discharged against the one lateral side portion.

20. The condenser of claim 19 in which:

the sidewall is elongate in a direction from the housing inlet to the housing outlet;

the conduit comprises a conduit portion located in the predetermined region above the housing outlet and formed with a multiplicity of apertures;

the apertures face toward the one lateral side portion of the housing and are spaced-apart along the length of the one lateral side portion thereby to distribute the discharged refrigerant flow along the length of the one lateral side portion.

21. The condenser of claim 20 in which the conduit portion is positioned in an upper right-hand quadrant of the reservoir as viewed from the housing inlet toward the housing outlet.

22. The condenser of claim 20 in which:

each of the apertures is substantially circular with a diameter of about 3/32 of an inch; and, the conduit portion is spaced between about one and one-quarter inches and one and one-half inches from the one lateral side portion of the housing.

23. The condenser of claim 19 in which the inlet and the outlet are aligned with a predetermined axis and are positioned a predetermined distance above the bottom of the reservoir thereby defining a region at the bottom of the reservoir in which debris can settle.

* * * * *